US010066498B2

(12) United States Patent
Naunheim

(10) Patent No.: US 10,066,498 B2
(45) Date of Patent: Sep. 4, 2018

(54) EXHAUST GAS TURBOCHARGER WITH TURBINE

(71) Applicant: Bosch Mahle Turbo Systems GmbH & Co. KG, Stuttgart (DE)

(72) Inventor: Dirk Naunheim, Stuttgart (DE)

(73) Assignee: Bosch Mahle Turbo Systems GmbH & Co. KG (DE)

( * ) Notice: Subject to any disclaimer, the term of this patent is extended or adjusted under 35 U.S.C. 154(b) by 668 days.

(21) Appl. No.: 14/476,051

(22) Filed: Sep. 3, 2014

(65) Prior Publication Data

US 2015/0064031 A1 Mar. 5, 2015

(30) Foreign Application Priority Data

Sep. 4, 2013 (DE) ..... 10 2013 217 677

(51) Int. Cl.
*F04D 29/46* (2006.01)
*F01D 17/14* (2006.01)
*F01D 17/16* (2006.01)

(52) U.S. Cl.
CPC ..... *F01D 17/141* (2013.01); *F01D 17/148* (2013.01); *F01D 17/165* (2013.01); *F04D 29/462* (2013.01); *F05D 2220/40* (2013.01)

(58) Field of Classification Search
CPC .... F01D 17/141; F01D 17/148; F01D 17/165; F01D 17/143; F01D 17/16; F01D 17/167;
(Continued)

(56) References Cited

U.S. PATENT DOCUMENTS 8,376,695 B2 * 2/2013 Scholz ..... F01D 17/165 415/164
2009/0317247 A1 * 12/2009 Hoecker ..... F01D 9/04 415/213.1

(Continued)

FOREIGN PATENT DOCUMENTS

DE 10337495 A1 3/2005
DE 102008005404 A1 7/2009

(Continued)

OTHER PUBLICATIONS

German Search Report for DE102013217677.5, dated Mar. 17, 2014.

(Continued)

*Primary Examiner* — Dominick L Plakkoottam
*Assistant Examiner* — Philip Stimpert
(74) *Attorney, Agent, or Firm* — Fishman Stewart PLLC

(57) ABSTRACT

A turbine for a supercharging device of an internal combustion engine may include a turbine wheel which is rotatably arranged about an axis of rotation in a turbine housing. A radial inflow channel may be arranged coaxially to the turbine wheel, which leads to a radial inlet region of the turbine wheel. The inflow channel may be axially bounded on one side by a blade carrier and axially bounded on the other side by a cover disc. A plurality of guide blades may be pivotably arranged on the blade carrier, and a plurality of spacer elements may axially project from the blade carrier. An axial outflow channel may be arranged coaxially to the turbine wheel, which leads from the inlet region to an axial outlet region of the turbine wheel, which may be radially bounded by an inner contour formed complementary to an outer contour of the rotating turbine wheel.

14 Claims, 2 Drawing Sheets

(58) Field of Classification Search
CPC .. F05D 2220/40; F04D 29/368; F04D 29/462; F04D 29/464; F04D 27/0246
See application file for complete search history.

(56) References Cited

U.S. PATENT DOCUMENTS

| | | | | |
|---|---|---|---|---|
| 2011/0014034 | A1 | 1/2011 | Blummel et al. | |
| 2011/0038742 | A1* | 2/2011 | Fleig | F01D 17/165 417/406 |
| 2014/0212306 | A1 | 7/2014 | Fleig et al. | |

FOREIGN PATENT DOCUMENTS

| | | | |
|---|---|---|---|
| DE | 102008000776 | A1 | 8/2009 |
| DE | 102008020732 | A1 | 11/2009 |
| DE | 102009009129 | A1 | 8/2010 |
| WO | WO-2009/076062 | A2 | 12/2000 |

OTHER PUBLICATIONS

English abstract for DE-10337495.
English abstract for DE-102008020732.
English abstract for DE-102009009129.

* cited by examiner

EXHAUST GAS TURBOCHARGER WITH TURBINE

CROSS-REFERENCE TO RELATED APPLICATIONS

This application claims priority to German Patent Application No. 10 2013 217 677.5 filed Sep. 4, 2013, the contents of which are hereby incorporated by reference in their entirety.

TECHNICAL FIELD

The present invention relates to a turbine for a supercharging device, in particular for an exhaust gas turbocharger, of an internal combustion engine, having the features of the preamble of claim 1. The invention additionally relates to an exhaust gas turbocharger that is equipped with such a turbine.

BACKGROUND

Such a turbine is known from DE 103 37 495 A1. It comprises in the usual manner a turbine wheel, which is rotatably arranged about an axis of rotation in a turbine housing. The turbine is equipped with a geometry adjusting device for performance control, with the help of which a geometry of the turbine wheel on the inflow side can be adjusted. Such a geometry adjusting device is usually also referred to as a variable turbine geometry. Accordingly, the turbine comprises a radial inflow channel that is arranged coaxially to the turbine wheel, which leads to a radial inlet region of the turbine wheel and which on the one hand is axially bounded by a blade carrier and on the other hand is axially bounded by a cover disc. On the blade carrier, multiple guide blades are pivotably arranged. By pivoting the guide blades, the flow geometry in the inflow channel, i.e. on the inflow side of the turbine wheel, can be adjusted. Furthermore, multiple spacer elements are arranged in the inflow channel, which axially project from the blade carrier and which adjust a predetermined spacing between blade carrier and cover disc. In addition, the turbine is equipped with an axial outflow channel that is arranged coaxially to the turbine wheel, which leads from the inlet region to an axial outlet region of the turbine wheel and which comprises an inner contour which is formed complementarily to the outer contour of the rotating turbine wheel and extends from the inlet region to the outlet region.

For the efficiency of the turbine, as narrow as possible a radial gap between the housing-sided inner contour and the outer contour of the turbine wheel is required. Here, thermally-related expansion effects on the one hand can determine the gap size. On the other hand, contaminations carried along in the exhaust gas can be deposited on the inner contour. To avoid these problems, the inner contour is formed on a contour sleeve that is separate with respect to the turbine housing, and which is connected to the cover disc in a fixed manner. In the known turbine, the contour sleeve is integrally moulded on the cover disc. In the mounted state, the cover disc loosely contacts the turbine housing axially. In the known turbine, the cover disc with inner contour moulded thereon is connected to the blade carrier in a fixed manner, which in turn is connected to the turbine housing in a fixed manner. The fixed connection between cover disc and blade carrier in this case is effected by means of screw connections, which are formed in the region of the space elements.

It has been shown that a fixed connection between cover disc and blade carrier can be disadvantageous during the heating-up of the turbine. In particular, the components which are fastened to one another can be distorted relative to one another during rapid heating-up, which increases wear and the risk of damages.

SUMMARY

The present invention deals with the problem of stating a separate embodiment for a turbine, which is characterized by a contour sleeve having an inner contour that is separate with respect to the turbine housing, which is characterized in particular by improved heating-up behaviour.

According to the invention, this problem is solved through the subject of the independent claim. Advantageous embodiments are subject of the dependent claims.

The invention is based on the general idea of floatingly arranging the cover disc relative to the blade carrier together with the contour sleeve that is connected to said cover disc in a fixed manner in such a way that the cover disc with the contour sleeve can thermally-induced expand or shrink in a plane running perpendicularly to the axis of rotation of the turbine wheel largely independently of the blade carrier and independently of the turbine housing. This is achieved with spacer elements in that all spacer elements loosely contact the cover disc axially. Because of this the cover disc is at least in regions moveable relative to the blade carrier transversely to the axial direction, i.e. transversely to the axis of rotation. Since the cover disc additionally loosely contacts the turbine housing axially, it is also adjustable relative to the turbine housing transversely to the axial direction. According to an advantageous embodiment, at least one spacer element is equipped on its axial face end axially contacting the cover disc with a guide pin that axially projects from the face end, which axially engages in a guide opening formed on the cover disc. Through this measure, the cover disc can be positioned relative to the blade carrier in the region of the respective spacer element transversely to the axial direction without in the process otherwise restricting the movability of the cover disc.

According to a further development, at least one such guide opening can be configured as a centring opening or centring bore, which fixes the guide pin engaging therein in the circumferential direction and radially relative to the cover disc. Through this measure, the centring bore with the guide pin engaging therein and centred therein forms a centre or a pole in the region of the associated spacer element from which the expansion and shrinkage movements of the cover disc relative to the blade carrier originates. In the region of this spacer element, a fixed bearing is thus defined while the other spacer elements then define loose bearings.

In another further development, at least one such guide opening can be configured as a radially orientated long opening or as a radially orientated elongated hole, which fixes the guide pin engaging therein only in the circumferential direction relative to the cover disc. Through this measure, the cover disc is secured against rotary movements about the axis of rotation in the region of this spacer element while radial expansions and shrinkages are still possible as before.

According to a particularly advantageous embodiment, at least one spacer element can comprise a flat axial face end, which axially contacts the cover disc. With this spacer element, the cover disc is freely moveable in all directions transversely to the axial direction with respect to the spacer element and thus with respect to the blade carrier.

Preferred is an embodiment, in which at least three spacer elements which are arranged distributed in the circumferential direction are provided, of which exactly one spacer element, which in the following is referred to as first spacer element, comprises a guide pin on its axial face end contacting the cover disc which axially stands away from said face end, which engages in a centring opening or centring bore formed on the cover disc, which fixes the guide pin in the circumferential direction and radially relative to the cover disc. In the region of this first spacer element, a centre for expansion movements and shrinkage movements of the cover disc are thus defined. Of the at least three spacer elements, at least one second spacer element is equipped on its axial face end axially contacting the cover disc with a guide pin that axially projects from the face end, which engages in a radially orientated elongated hole formed on the cover disc, which fixes the guide pin relative to the cover disc only in the circumferential direction. In connection with the first spacer element, which defines a centre of the relative movements between cover disc and blade carrier, the respective second spacer element brings about an anti-rotation safeguard for the cover disc relative to the blade carrier. Because of this it is achieved that the relative movements of the cover disc relative to the blade carrier do not result in that the contour sleeve that is connected therewith comes into contact with the turbine wheel.

In the case of three or more spacer elements, two or more spacer elements can also be provided in principle. However, a single second spacer element is adequate in principle.

According to an advantageous further development, at least one of the three or more spacer elements can form a third spacer element, which is configured flat on its axial face end axially contacting the cover disc. The respective third spacer element because of this has no positioning effect transversely to the axial direction.

In a preferred further development, in which at least three spacer elements are provided, only one first spacer element, only one second spacer element and at least one third spacer element are provided. Particularly advantageous is an embodiment, in which only three spacer elements are provided, so that only one first spacer element, only one second spacer element and at least one third spacer element are then provided.

First and second spacer element can, in principle, be configured identical in construction so that they ultimately differ from one another only through the shape of the associated guide opening. The first spacer element is assigned the centring opening, while the second spacer element is assigned the elongated hole. The respect third spacer element differs from the first spacer element or from the second spacer element through absence of a guide pin.

In another embodiment, the cover disc and the contour sleeve can be produced from one piece. In this case, the contour sleeve is thus integrally moulded on the cover disc. For example, cover disc and contour sleeve can be produced by a single integral casting.

According to another embodiment, the cover disc and the contour sleeve can consist of a material other than the turbine housing. For example, a material can be selected for this purpose which has a particularly high thermal strength. Furthermore, a material which makes possible a better surface quality can be used, as a result of which the risk of deposits in the region of the inner contour can be reduced.

It is possible, furthermore, to form the turbine housing by a sheet metal body or assemble it from multiple sheet metal bodies, as a result of which the turbine housing can be realised particularly cost-effectively. Furthermore, an annular gap can be realised between the contour sleeve and the turbine housing. Such an annular gap on the one hand makes possible relative movements between the contour sleeve and thus also the cover disc connected therewith relative to the turbine housing. On the other hand, an air gap insulation between the contour sleeve and the turbine housing can be realised with the help of such an annular gap.

In another advantageous embodiment, the spacer elements can each loosely contact the blade carrier with their axial face end and on this axial face end have a positioning pin each which axially projects from this face end, which axially engages in a positioning opening formed on the blade carrier, which fixes the respective positioning pin in the circumferential direction and radially relative to the blade carrier. In other words, the spacer elements are each positioned on the blade carrier by means of a plug connection, for the purpose of which the respective positioning pin axially engages in the associated positioning opening. The spacer elements are thus neither axially fixed on the blade carrier nor on the cover disc, as a result of which the production of the turbine is substantially simplified. In principle, the positioning pins and the guide pins can be configured identically, as a result of which the spacer elements, in particular the previously mentioned first and second spacer elements, can be mounted in a confusion-proof manner.

An exhaust gas turbocharger according to the invention comprises a turbine of the type described above, the turbine wheel of which is connected to a compressor wheel of a compressor of the exhaust gas turbocharger in a rotationally fixed manner, for example via a common bearing shaft.

Further important features and advantages are obtained from the subclaims, from the drawings and from the associated figure description with the help of the drawings.

It is to be understood that the features mentioned above and still to be explained in the following cannot only be used in the respective combination stated but also in other combinations or by themselves without leaving the scope of the present invention.

BRIEF DESCRIPTION OF THE DRAWINGS

Preferred exemplary embodiments of the invention are shown in the drawings and are explained in more detail in the following description, wherein same reference characters relate to same or similar or functionally same components. In shows in each case schematically, FIG. 1 an isometric sectional view of an exhaust gas turbocharger in the region of a turbine, in which a spacer element is noticeable, FIG. 2 another isometric sectional view of the turbocharger, in which two spacer elements are noticeable, FIG. 3 an axial view of the turbocharger with opened housing.

DETAILED DESCRIPTION

Figure 1:
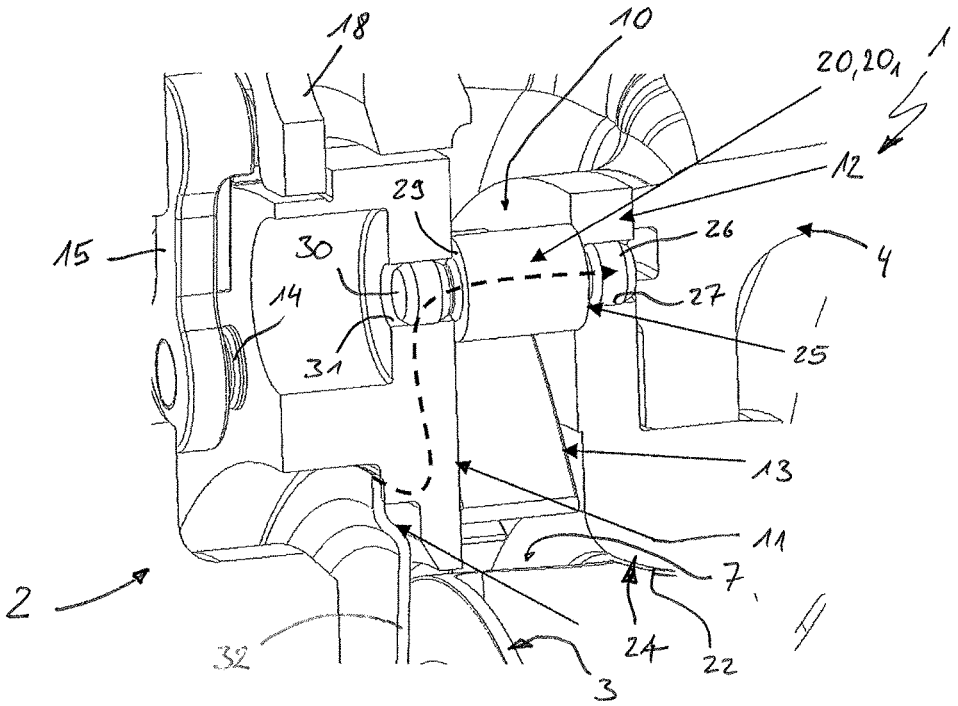
Figure 2:
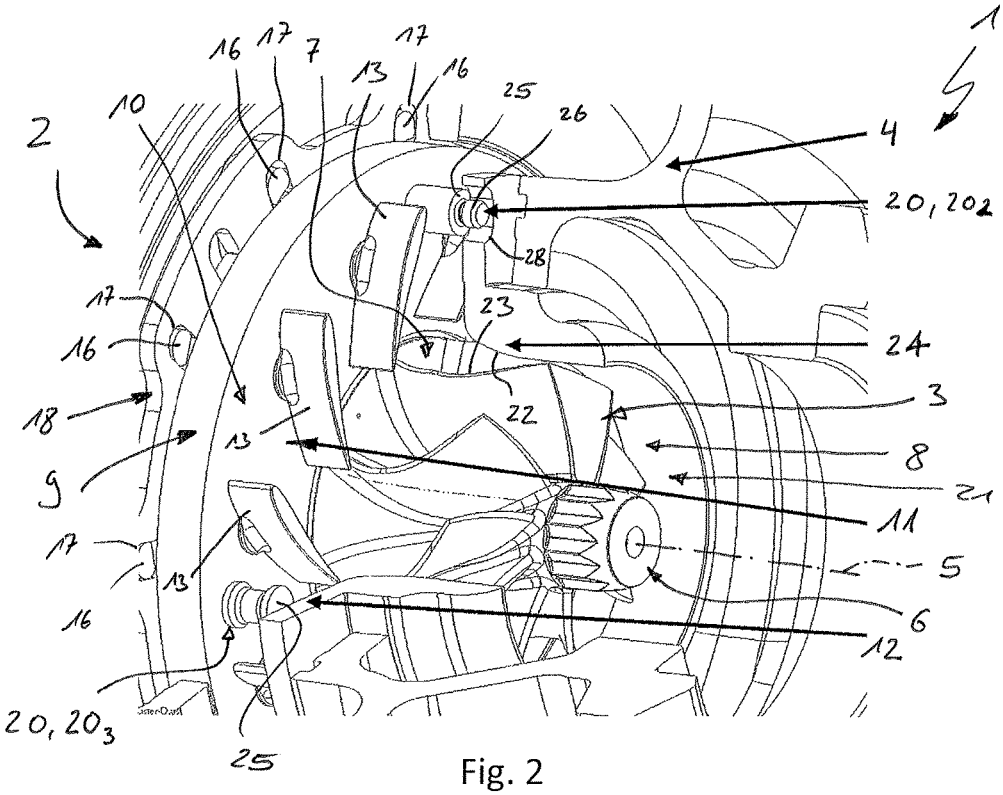
Figure 3:
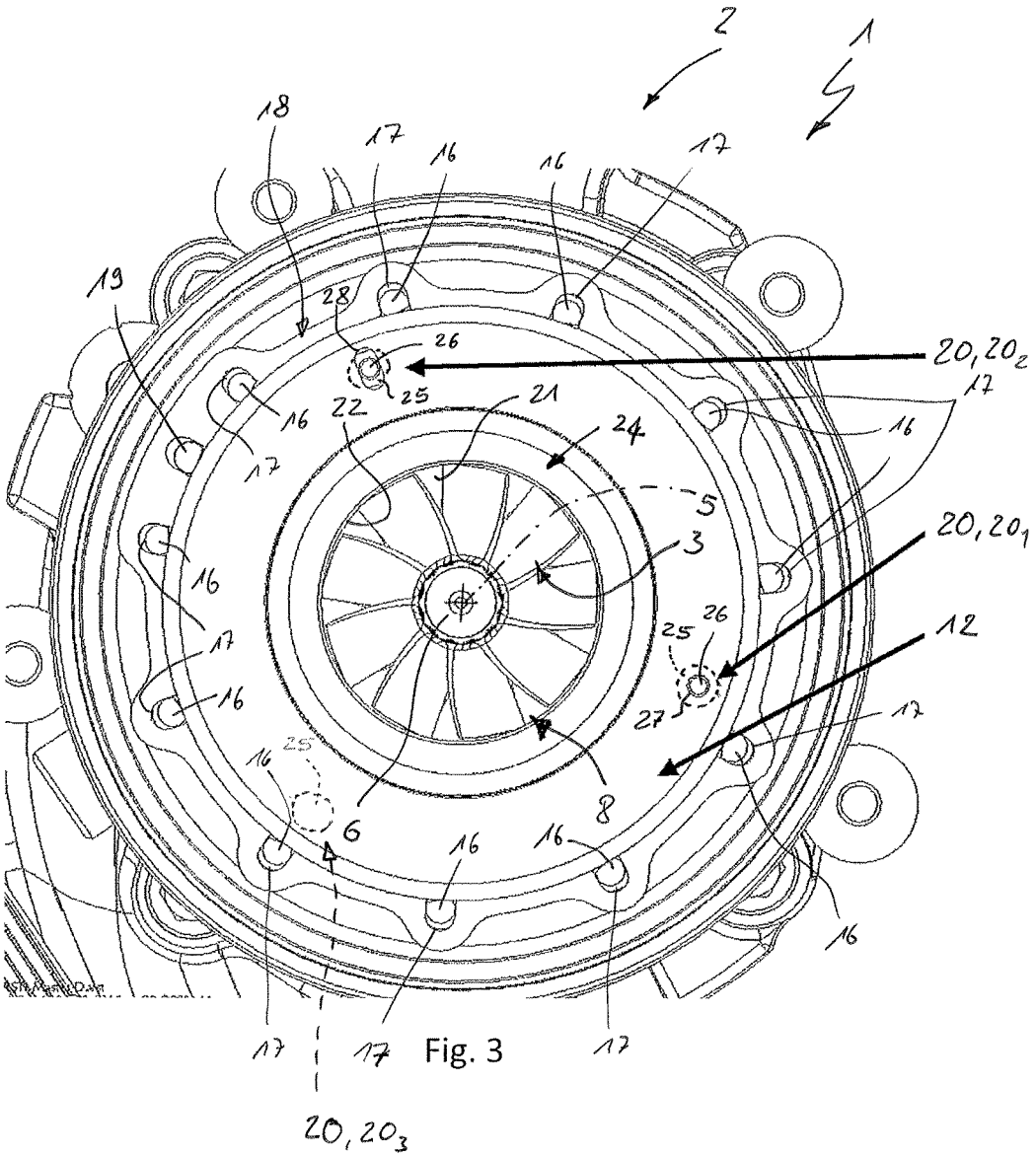

According to the FIGS. 1 to 3, an exhaust gas turbocharger 1 comprises a turbine 2 and a compressor which is not shown here. The turbine 2 comprises a turbine wheel 3, which is rotatably arranged about an axis of rotation 5 in a turbine housing 4. Practically, the turbine wheel 3 for this purpose is arranged in a rotationally fixed manner on a shaft 6, which is rotatably mounted about the axis of rotation 5 in a bearing housing which is not shown here and which in a compressor housing which is not shown here is connected to a compressor wheel which is likewise not shown in a rotationally fixed manner. The turbine wheel 3 has a radial inlet region 7 and an axial outlet region 8. Inlet region 7 and outlet region 8 are arranged coaxially to the turbine wheel 3.

For realising a variable turbine geometry, a geometry adjusting device globally designated with 9 is provided, with the help of which a geometry of the turbine 2 can be changed or specifically adjusted in the flow path upstream of the turbine wheel 3. In detail, a radial, annular inflow channel 10 is provided for this purpose coaxially to the turbine wheel 3, which leads to the inlet region 7 of the turbine wheel 3. The inflow channel 10 is axially bounded axially on the one hand by an annular blade carrier 11 and axially on the other hand by an annular cover disc 12. On the blade carrier 11, multiple guide blades 13 are pivotably arranged, the pivot axes of the guide blades 13 of which in this case run parallel to the axis of rotation 5. For this purpose, the respective guide blade 13 according to FIG. 1 can penetrate the guide blade carrier 11 with a pin 14 in the usual manner and be connected to a drive lever 15 in a rotationally fixed manner on a side of the blade carrier 11 facing away from the inflow channel 10. The drive lever 15 according to the FIGS. 2 and 3 engages spaced from the pin 14 on the outer circumference of the blade carrier 11 into a recess 17 of an adjusting ring 18 with the help of an axial protrusion 16, which adjusting ring 18 in turn is drive connected to a drive lever 19 which is noticeable in FIG. 3. By twisting the adjusting ring 18, all guide blades 13 can be simultaneously and uniformly pivoted.

In FIG. 3, the turbine housing 4 has been at least partially omitted in order to make possible an axial view onto the cover 12, namely on a side facing away from the inflow channel 10.

Multiple spacer elements 20 axially project from the blade carrier 11 according to the FIGS. 1 and 2. Preferably, three or more such spacer elements 20 are provided here, which are provided evenly distributed in the circumferential direction. Particularly advantageous is an embodiment, in which exactly three such spacer elements 20 are provided. The spacer elements 20 like the guide blades 13 are arranged in the inflow channel 10.

In addition, the turbine 2 is equipped with an axial outflow channel 21, which is likewise arranged coaxially to the turbine wheel 3. The outflow channel 21 leads from the inlet region 7 to the outlet region 8. The outflow channel 21 in this case is bounded in the radial direction by an inner contour 22, which is formed complementarily to an outer contour 23 of the rotating turbine wheel 3. This virtual outer contour 23 of the turbine wheel 3 is obtained only through rotation of the actual outer contour of the turbine wheel 3, which is formed through the individual edges located outside of the individual blades of the turbine wheel 3 which are not designated in more detail. The inner contour 22 extends from the inlet region 7 as far as to the outlet region 8 and is formed on a contour sleeve 24, which with respect to the turbine housing 4 forms a separate component. The contour sleeve 24 is connected to the cover disc 12 in a fixed manner. In the mounted state of the turbine 2, the cover disc 12 loosely contacts the turbine housing 4 axially. Furthermore, all spacer elements 20 loosely contact the cover disc 12 axially.

The blade carrier 11 is arranged on the turbine housing in a rotationally fixed manner and in an axially loose manner. Because of this, the blade carrier 11 can be axially preloaded by means of a preload spring 32, which is configured as a disc spring here in such a manner that the blade carrier 11 axially supports itself via the spacer elements 20 on the cover disc 12 and via the latter on the turbine housing 4.

In the preferred embodiment shown here, exactly three spacer elements 20 are provided, which are arranged evenly distributed in the circumferential direction. These three spacer elements 20 thus comprise a first spacer element $\mathbf{20}_1$, a second spacer element $\mathbf{20}_2$ and a third spacer element $\mathbf{20}_3$.

The first spacer element $\mathbf{20}_1$ has on its axial face end 25 axially contacting the cover disc 12 a guide pin 26 axially projecting from this face end 25. The guide pin 26 of the first spacer element $\mathbf{20}_1$ engages in a centring bore 27, which is formed on the cover disc 12. Accordingly, guide pin 26 and centring bore 27 are matched to one another so that the centring bore 27 fixes the guide pin 26 inserted therein in the circumferential direction and radially relative to the cover disc 12. Thus, the cover disc 12 cannot move relative to the blade carrier 11 in the region of the first spacer element $\mathbf{20}_1$ transversely to the axial direction. The first spacer element $\mathbf{20}_1$ because of this defines a pole for the thermally-related expansion and shrinkage movements of the cover disc 12 relative to the blade carrier 11.

The second spacer element $\mathbf{20}_2$ on its axial face end 25 axially contacting the cover disc 12 likewise has a guide pin 26 axially projecting from the face end 25, which at the second spacer element $\mathbf{20}_2$ however engages in a radially orientated elongated hole 28, which for this purpose is formed on the cover disc 12. Elongated hole 28 and guide pin 26 in this case are matched to one another so that the elongated hole 28 fixes the guide pin 26 inserted therein in the circumferential direction relative to the cover disc 12, while it is moveable in the radial direction thereto. With the help of the second spacer element $\mathbf{20}_2$ a rotational position securing safeguard for the cover disc 12 relative to the blade carrier 11 can thus be produced.

The third spacer element $\mathbf{20}_3$ is configured flat on its axial face end 25 axially contacting the cover disc 12, so that the cover disc 12 is adjustable as desired transversely to the axial direction on the face end 25 of the third spacer element $\mathbf{20}_3$.

Provided that as is the case here, exactly three spacer elements 20 are provided, it is practical to provide both a second spacer element $\mathbf{20}_2$ as well as a third spacer element $\mathbf{20}_3$. In principle, two second spacer elements $\mathbf{20}_2$ can also be provided.

Provided that more than three spacer elements 20 are provided, two or more second spacer elements $\mathbf{20}_2$ and/or two or more third spacer elements $\mathbf{20}_3$ can also be provided. Preferred is an embodiment, in which only one first spacer element $\mathbf{20}_1$ and only one second spacer element $\mathbf{20}_2$ are provided, while all remaining spacer elements 20 are configured as third spacer elements $\mathbf{20}_3$.

In principle, the guide pins 26 of the first spacer element $\mathbf{20}_1$ and of the second spacer element $\mathbf{20}_2$ can be configured identically. In particular, the first spacer element $\mathbf{20}_1$ and the second spacer element $\mathbf{20}_2$ can then be embodied identical in construction.

As is evident in particular from FIG. 1, the spacer elements 20 with their axial face end 29 facing the blade carrier 11 can loosely contact the blade carrier 11 axially, wherein the spacer elements 20 on this axial face end 29 can each comprise a positioning pin 30 that axially projects from this face end 29, which axially engages in a positioning opening 31 formed on the blade carrier 11. Positioning opening 31 and positioning pin 30 are matched to one another so that the positioning opening 31 fixes the positioning pin 30 inserted therein in the circumferential direction and radially relative to the blade carrier 11. In principle, positioning pin 30 and guide pin 26 can be configured identical in construction, as a result of which the assembly of the turbine 2 introduced here is substantially simplified.

As is evident in the FIGS. 1 and 2, the cover disc 12 and the contour sleeve 24 are preferably produced from one piece, in particular as a unitary or as a single casting. Because of this, the cover disc 12 and the contour sleeve 24 can be produced from a material other than the turbine housing 4. For example, the turbine housing 4 can be a formed sheet metal part, while the unit of cover disc 12 and contour sleeve 24 is a casting.

The invention claimed is:

1. A turbine for a supercharging device of an internal combustion engine, comprising:

a turbine housing;

a turbine wheel rotatably arranged about a rotation axis in the turbine housing, the turbine wheel defining a radial inlet region, an axial outlet region and an outer contour formed during rotation;

an annular blade carrier;

an annular cover disc including a plurality of guide openings, the plurality of guide openings including at least a centring bore and a radially elongated hole;

a radial inflow channel arranged coaxially to the turbine wheel and fluidly connected to the inlet region of the turbine wheel, wherein the inflow channel is axially bounded on one side by the blade carrier and axially bounded on the other side by the cover disc;

a plurality of guide blades pivotably arranged on the blade carrier;

a plurality of spacer elements projecting axially from the blade carrier and contacting the cover disc axially;

a contour sleeve fixedly connected to the cover disc, the contour sleeve defining an inner contour formed complementary to the outer contour of the turbine wheel;

an axial outflow channel arranged coaxially to the turbine wheel and extending from the inlet region to the outlet region of the turbine wheel, wherein the outflow channel is radially bounded by the inner contour defined by the contour sleeve, and the inner contour defined by the contour sleeve extends from the inlet region to the outlet region;

the contour sleeve arranged separate from the turbine housing and the cover disc contacts the turbine housing in an axial direction of the rotation axis such that the cover disc together with the contour sleeve are mounted moveable relative to the turbine housing transversely to the axial direction of the rotation axis;

the plurality of spacer elements distributed about the blade carrier in a circumferential direction and including a first spacer element and a second spacer element, the first spacer element and the second spacer element each provided with an axial face end and a guide pin projecting axially from the axial face end;

wherein the guide pin of the first spacer element engages axially into the centring bore disposed on the cover disc and is fixed by the centring bore in the circumferential direction and radially relative to the cover disc; and wherein the guide pin of the second spacer element engages axially into the radially elongated hole disposed on the cover disc and is fixed by the radially elongated hole in the circumferential direction with respect to the cover disc.

2. The turbine according to claim 1, wherein the turbine housing has an axial face opposite the cover disc where the plurality of guide openings are disposed, and wherein the guide pins of the first spacer element and the second spacer element engages into the centring bore and the radially elongated hole, respectively, without penetrating into the axial face of the turbine housing to facilitate relative movement between the cover disc together with the contour sleeve and the turbine housing transversely to the axial direction.

3. The turbine according to claim 1, wherein the plurality of guide openings further include a second radially elongated hole that fixes a guide pin of another one of the plurality of spacer elements engaging therein in the circumferential direction relative to the cover disc.

4. The turbine according to claim 1, wherein the plurality of spacer elements further include at least one third spacer element having a flat axial face end that axially contacts the cover disc.

5. The turbine according to claim 4, wherein the at least one third spacer element includes at least two third spacer elements.

6. The turbine according to claim 1, wherein the cover disc and the contour sleeve define a single unit distinct from the turbine housing to facilitate thermally-induced deformation of the single unit independently of the turbine housing.

7. The turbine according to claim 1, wherein the cover disc and the contour sleeve are composed of a material other than that of the turbine housing.

8. The turbine according to claim 1, wherein at least one of the first spacer element and the second spacer element of has a second axial face end contacting the blade carrier in the axial direction;

the second axial face end including an axially projecting positioning pin that axially engages into a positioning opening disposed on the blade carrier to define a first plug connection between the at least one of the first spacer element and the second spacer element and the blade carrier;

wherein the guide pins of the at least one of the first spacer element and the second spacer element that axially engages into a corresponding one of the plurality of guide openings defines a second plug connection between the at least one of the first spacer element and the second spacer element and the cover disc; and wherein the positioning opening disposed in the blade carrier fixes the positioning pin in the circumferential direction and radially relative to the blade carrier.

9. The turbine according to claim 8, wherein the first plug connection and the second plug connection mount the at least one of the first spacer element and the second spacer element on the blade carrier and the cover disc with freedom of movement in the axial direction.

10. The turbine according to claim 1, wherein the contour sleeve is arranged spaced apart from the turbine housing to define an annular gap between the contour sleeve and the turbine housing, the annular gap delimited axially by the contour sleeve and the turbine housing.

11. An exhaust gas turbocharger having a compressor and a turbine, comprising:

a turbine housing;

a turbine wheel rotatably arranged in the turbine housing about a rotation axis and having a radial inlet region and an axial outlet region with respect to the rotation axis, the turbine wheel drive-connected with a compressor wheel;

an annular blade carrier;

an annular cover disc;

a radial inflow channel arranged coaxially to the turbine wheel leading to the radial inlet region of the turbine wheel, the inflow channel being axially delimited on one side by the blade carrier and on the other side by the cover disc;

a plurality of guide blades pivotally arranged on the blade carrier;

a plurality of spacer elements axially projecting from the blade carrier and contacting the cover disc in an axial direction of the rotation axis;

a contour sleeve fixedly connected to the cover disc and defining an inner contour formed complementary to an outer contour of the turbine wheel;

an axial outflow channel arranged coaxially to the turbine wheel and leading from the inlet region to the outlet region of the turbine wheel, wherein the outflow channel is radially delimited by the inner contour of the contour sleeve, the inner contour defined by the contour sleeve extends from the inlet region to the outlet region;

wherein the contour sleeve is arranged separate from the turbine housing and the cover disc contacts the turbine housing in the axial direction of the rotation axis such that the contour sleeve and the cover disc together are mounted adjustable relative to the turbine housing transversely to the axial direction of the rotation axis;

wherein the plurality of spacer elements are distributed on the blade carrier in a circumferential direction and include a first spacer element and at least one second spacer element;

the first spacer element having an axial face end axially contacting the cover disc and including a guide pin axially projecting from the axial face end, the guide pin engaging into a centring bore disposed on the cover disc, the centring bore fixing the guide pin in the circumferential direction and radially relative to the cover disc; and the at least one second spacer element having an axial face end axially contacting the cover disc and including a guide pin axially projecting from the axial face end, the guide pin of the at least one second spacer element engaging into a radially elongated hole extending through the cover disc, the radially elongated hole fixing the guide pin of the at least one second spacer element in the circumferential direction relative to the cover disc.

12. The turbocharger according to claim 11, wherein the plurality of spacer elements further include at least one third spacer element having a flat axial face end contacting the cover disc in the axial direction.

13. The turbine according to claim 11, wherein the contour sleeve is arranged spaced apart from the turbine housing to define an annular gap between the contour sleeve and the turbine housing, the annular gap delimited axially by the contour sleeve and the turbine housing.

14. A turbine for a supercharging device of an internal combustion engine, comprising:

a turbine housing;

a turbine wheel rotatably arranged about a rotation axis in the turbine housing, the turbine wheel defining a radial inlet region, an axial outlet region and an outer contour formed during rotation;

an annular blade carrier;

an annular cover disc;

a radial inflow channel arranged coaxially to the turbine wheel and fluidly connected to the inlet region of the turbine wheel, wherein the inflow channel is axially bounded on one side by the blade carrier and axially bounded on the other side by the cover disc;

a plurality of guide blades pivotably arranged on the blade carrier;

a plurality of spacer elements axially projecting from the blade carrier;

a contour sleeve fixedly connected to the cover disc, the contour sleeve defining an inner contour formed complementary to the outer contour of the turbine wheel;

an axial outflow channel arranged coaxially to the turbine wheel and extending from the inlet region to the outlet region of the turbine wheel, wherein the outflow channel is radially bounded by the inner contour defined by the contour sleeve, and the inner contour defined by the contour sleeve extends from the inlet region to the outlet region;

the contour sleeve arranged separate from the turbine housing, and the cover disc contacts the turbine housing in an axial direction of the rotation axis such that the cover disc together with the contour sleeve are mounted moveable relative to the turbine housing transversely to the axial direction of the rotation axis;

wherein the plurality of spacer elements contact the cover disc axially in a manner facilitating relative movement in at least some regions of the cover disc with respect to the blade carrier transversely to the axial direction, the plurality of spacer elements including at least a first spacer element and a second spacer element arranged on the blade carrier distributed in a circumferential direction;

the first spacer element having an axial face end axially contacting the cover disc, and includes a guide pin projecting axially from the axial face end and axially engaging in a centring bore disposed on the cover disc, the centring bore fixing the guide pin in the circumferential direction and radially relative to the cover disc; and the second spacer element having an axial face end axially contacting the cover disc, and includes a guide pin projecting axially from the axial face end and engaging in a radially elongated hole extending through the cover disc, the radially elongated hole fixing the guide pin of the second spacer element in the circumferential direction relative to the cover disc.

* * * * *